United States Patent [19]

Schaar

[11] Patent Number: 4,669,445

[45] Date of Patent: Jun. 2, 1987

[54] ARCHERY BOW LIMB

[75] Inventor: John Schaar, Tempe, Ariz.

[73] Assignee: Grand Slam Archery, Ltd., Tempe, Ariz.

[21] Appl. No.: 600,443

[22] Filed: Apr. 16, 1984

[51] Int. Cl.[4] ..... F41B 5/00

[52] U.S. Cl. ..... 124/23 R; 124/DIG. 1

[58] Field of Search ..... 124/23 R, 24 R, DIG. 1

[56] References Cited

U.S. PATENT DOCUMENTS 1,877,273 9/1932 Cowdery ..... 124/23 R 4,350,138 9/1982 Caldwell ..... 124/24 R

*Primary Examiner*—Richard C. Pinkham

*Assistant Examiner*—Benjamin Layno

*Attorney, Agent, or Firm*—Don J. Flickinger; Jordan M. Meschkow

[57] ABSTRACT

Limb/pulley torque in a compound bow is negated by providing a restoring force, as a result of the deflected bow when drawn, comprised of unequal components which balance the torsional force imparted to the bow end by the summation of forces applied by the cable. In accordance with one embodiment, the unequal components are achieved by employing unequal cross sectional areas in the material of the respective two sides about the longitudinal axis of the bow. In another embodiment, the pulley/cam structure and the tieoff element which support the cable are spaced at predetermined distances from the longitudinal axis of the bow to yield respective torque having equal magnitude and opposite direction.

21 Claims, 14 Drawing Figures

ARCHERY BOW LIMB

BACKGROUND OF THE INVENTION

1. Field of the Invention

This invention relates to the field of archery.

More particularly, the present invention relates to an item of archery equipment generally referred to as a compound bow.

In a further and more specific aspect, the present invention concerns improvements to materially reduce the effects of induced torsion in a compound bow limb.

2. Description of the Prior Art

Archery, the art of shooting with bows and arrows, is an anchient practice which has been continued to the present time. The traditional bow was merely a strip of flexible wood having a string or cord extending between the tips. Evolution over the centuries has resulted in the compound bow, familiar to modern archers.

Originally, archery equipment was exceedingly simple 2nd highly ineffective. The bow limbs, the portions of the bow extending in either direction from the handle section to the respective tips, were not torsionally balanced. Accordingly, in a condition referred to as "system torque", the tips of the bow pulled unequally upon the string, imparting erratic flight to the arrow.

Another pronounced problem with early equipment was the phenomenon known as "archers' paradox" which concerned the attempt of the arrow to have both ends travel in the same straight line to the target. The problem arose as a result of the rear tip of the arrow being propelled directly toward the target by the string which moves in a plane bisecting the center line of the bow and perpendicular to the target. The forward tip of the arrow, however, extends laterally from the plane of the string as a result of the width of the bow around which the arrow must pass.

Over the years, bows remained relatively unchanged. With the advent of modern materials and laminating technology, bow limbs were greatly improved. The new laminated structures, usually wood between layers of fiberglass, were of improved strength and balance. Grip sections incorporating relatively shallow "sight windows" also appeared. "Archers' paradox", though not eliminated, was reduced and made more reliably predictable.

In very recent times, there emerged the present-day "compound bow" consisting of extremely stout bow limbs secured to a central section or "handle riser". Generally fabricated of metal, the central section was of sufficient strength to accommodate a "sight window" of ample depth to eliminate the anchient "archers' paradox". A system of string, now more appropriately called cable, extending over pulleys at the ends of bow limbs allowed the average archer to draw a bow approximately twice as powerful as had previously been the case.

While providing numerous advantages and correcting various previous problems, the compound bow did not represent perfection. Especially notable was the twist or torsion introduced into the bow limbs as a result of the unbalanced loading of the pulleys. Characterized as "limb/pulley torque", it has remained a major cause of inferior arrow flight.

Typically, the compound bow limb is of comparatively uniform width terminating with a relatively broad tip which is bifurcated to form a pair of tip sections. A two-groove pulley and a single-groove roller are carried upon an axle extending between each of the tip sections. The roller, usually substantially smaller than the pulley, functions as a "tieoff buss". Three segments of a single cable extend between the tips of the bow.

A first segment of the cable extends between outboard grooves of the pulley. The other two segments extend between the inboard groove of the pulley and the roller at the opposite tip. Termed the "bow string", the first section is generally parallel to and spaced from the longitudinal axis of the bow. The other two sections are oblique to the longitudinal axis, crossing at the approximate midpoint of the bow. The ends of the latter two segments are terminated or tied off at the roller.

A primary recommendation of the compound bow is the mechanical advantage provided by the arrangement of cables and pulleys. The force with which the archer is required to hold when the bow is fully drawn is substantially less than the force by which the arrow is propelled. The advantage to the archer is further enhanced by the use of eccentric or off-center mounted pulleys. A usual arrangement provides approximately a 2:1 mechanical advantage.

There are, however, counteracting disadvantages. As the bow is drawn, the force on the bow string is approximately one-half the force on the other strings or cable segments. A force of corresponding magnitude is applied to each of the corresponding pulley grooves. In a bow capable of propelling an arrow with sixty pounds thrust, for example, thirty pounds of pressure is applied to the outboard groove of each of the eccentric pulleys. Correspondingly, sixty pounds of pressure is applied to the roller or "tieoff buss" and to each of the inboard grooves of each of the eccentric pulleys.

The placement of the pulley is rather rigidly defined. Ample strength must be maintained in the long tip sections to support the load transmitted through the pulleys to the axles and ultimately to the tip sections. It has been conventional procedure since the advent of the compound bow to align the pulleys in juxtaposition on the longitudinal axis of the limb between tip sections of substantially equal proportions. The forces absorbed by the limb, however, are asymmetrical or unbalanced relative to the longitudinal axis of the bow.

Consider, for purposes of illustration, a system in which the inboard groove of the eccentric pulley is in approximate alignment with the longitudinal axis of the bow limb. The outboard groove of the eccentric pulley and the groove of the smaller roller are substantially equally spaced on opposite sides thereof. Accordingly, unequal force is applied to the tip sections of the bow limb.

As the bow is drawn the tips move rearwardly, deflecting the limbs along the plane of movement of the bow string. Concurrently, the tip sections supporting the greater force move laterally, introducing twist or torsion into the bow limbs. Both movements store energy within the bow limbs.

Upon release of the bow string, the energy previously stored in the bow limbs is unleashed as the limbs straighten and return to normal or unstressed configuration. The energy, transmitted through the bow string, is the propelling force for the arrow. In the conventional compound bow, the propelling force includes a linear component directed toward the target as a result of the rearward deflection of the limbs and a torque component as a result of the twisting motion of the tips. The speed and direction of the arrow is the resultant of the components of the force.

It is well recognized by those skilled in the art that the arrow is whipped sideways, and therefore inaccurately, in response to the torque. It can be demonstrated that one-eighth of one inch, a realistic measurement depending upon the weight of the arrow, of twist of the pulleys can result in as much as ten inches of lateral dispersion of the arrow at forty yards.

Limb/pulley torque is responsible for additional undesirable results. Frequent longitudinal twisting accelerates fatigue and breakage of bow limbs. Also, the cable can slip from the grooves of the pulley which is tilted, thereby unstringing the bow. Further, arrow efficiency during downrange flight is adversly affected, reducing speed and penetration.

The prior art has proposed various solutions to the foregoing problems, including altered arrow design and various attachments and paraphernalia for bows. None of the suggested remedies has provided a satisfactory resolution. It would be highly advantageous, therefore, to remedy the foregoing and other inherent problems in the prior art.

Accordingly, it is an object of the present invention to provide improvements in archery equipment.

Another object of the invention is the provision of an improved compound bow.

And another object of the invention is to provide an improved bow limb of the type used in connection with compound bows.

Still another object of this invention is the provision of means which materially reduce the effects of limb-/pulley torque.

Yet another object of the immediate invention is to provide means whereby the resultant propelling force of the bow string is substantially directed toward the target or point of aim.

Still another object of the invention is the provision of means to eliminate twist in a bow limb.

A further object of the instant invention is to provide a balanced bow/limb system.

And a further object of the invention is the provision of an inherently balanced system without requiring attachments or encumbrances.

Still a further object of this invention is to provide an improved bow limb which is less susceptible to fatiguing and breaking.

And still a further object of the instant invention is the provision of improvements of the foregoing character which are relatively simple and inexpensive to effect.

SUMMARY OF THE INVENTION

Briefly, to achieve the desired objects of the instant invention in accordance with a preferred embodiment thereof, there is provided in a compound bow employing a two-adjacent element pulley/cam structure and a tieoff element at each bow end in connection with the cable which extends from a first tieoff element at each bow end to a first element of the pulley/cam structure at the second end, are improvements which the restoring force stored in each end of the compound bow, when drawn, is comprised of unequal components contributed by the deflected bow material the respective two sides about the bow axis and the difference between the unequal components being predetermined to exert a torsional force on the bow end which balances a torsional force imparted to the bow by the summation of forces applied to the pulley/cam structure and the tieoff element by the cable, thereby eliminating limb/pulley torque.

In accordance with a more specific embodiment, the unequal components are obtained by employing unequal cross sectional areas in the material of the respective two sides about the bow longitudinal axis along at least a portional length of the compound bow. In accordance with an embodiment of the invention, this is achieved by providing a bow limb which is generally trapezoidal in cross-section.

In accordance with another embodiment of the invention, there is provided a unitary pulley and tieoff element which is supported between equal components. The spacing between the grooves and the unitary pulley is such that the resultant of the unequal components is along the approximate lateral center of the unitary pulley structure.

BRIEF DESCRIPTION OF THE DRAWINGS

The foregoing and further and more specific objects and advantages of the instant invention will become readily apparent to those skilled in the art from the following detailed description of preferred embodiments thereof taken in conjuction with the drawings in which.

DETAILED DESCRIPTION OF THE PREFERRED EMBODIMENTS

Figure 1:
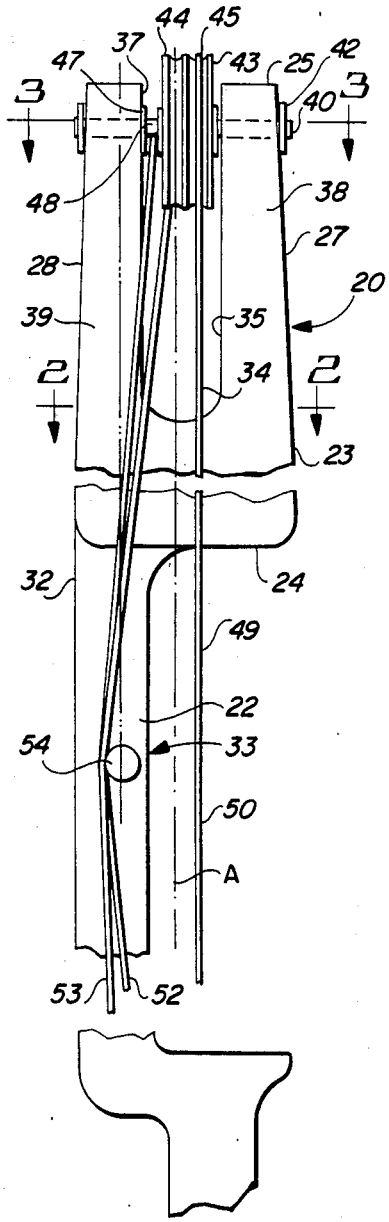
FIG. 1 (PRIOR ART)
FIG. 1 is a broken rear elevational view of the upper portion of a conventional prior art compound bow herein chosen for purposes of representative illustration.
Figure 2:
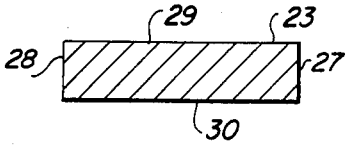
FIG. 2 is a horizontal sectional view taken along the line 2—2 of FIG. 1.

Turning now to the drawings, in which like reference characters indicate corresponding elements throughout the several views, attention is first directed to FIG. 1 which illustrates a typical prior art compound bow, generally designated by the reference character 20, including central section or handle riser 22 and oppositely extending bow limbs 23. Each bow limb 23 (only the upper one being illustrated herein) includes a fixed end 24 coupled to handle riser 22 and a tip end 25. In the immediate embodiment chosen for purposes of illustration, each bow limb 23 has a tip end 25 which is narrower than the fixed end 24 as evidenced by edges 27 and 28 which tend to converge in a direction toward tip end 25. As seen in FIG. 2, however, each bow limb 23 has a rectangular cross-section of relatively constant proportions. It is noted that the edges 27 and 28 are parallel as are the front side 29 and the rear side 30.

The longitudinal axis or center line of bow 20 is represented by the broken line A. Hand grip 32, that portion of handle riser 22 held by the hand of the archer, is generally aligned along axis A. Cut-out 33, the sight window through which the arrow passes, resides above hand grip 32. Bow limbs 23 are symmetrical about axis A.

Slot 34, defined by substantially parallel sides 35 and 37, is formed into bow limb 23 from tip end 25. Slot 34 bifurcates the terminal tip portion of bow limb 23 creating tip sections 38 and 39 of correspondingly uniform cross-section. Slot 34 functions as a housing for the pulley assembly.

Axle 40 supported by tip sections 38 and 39 extends through slot 34. Axle 40 extends beyond edges 27 and 28 and is retained by keepers 42. An eccentric pulley 43 having inboard groove 44 and outboard groove 45 is rotatably supported upon axle 40. A smaller tieoff roller 47 having groove 48 is also rotatably supported upon axle 40 adjacent the inboard groove side of larger pulley 43. The pulleys 43 and 47, variously referred to as cams, reside in juxtaposition having a total width approximating the distance between sides 35 and 37 of slot 34. Accordingly, there is no appreciable lateral movement of the pulleys upon the axle.

Figure 3:
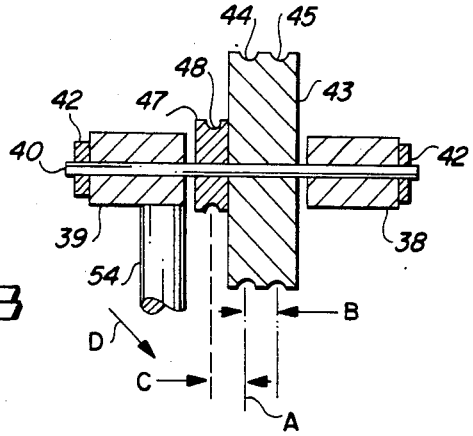
FIG. 3 is a horizontal sectional view taken along the line 3—3 of FIG. 1.

As will be appreciated by those skilled in the art, a mirror image arrangement of pulleys and associated grooves is carried by the bow limb not illustrated but extending in the opposite direction from handle riser 22. A single cable 49 continuously embraces the several grooves. A first segment 50 of cable 49 extends between corresponding outboard grooves 45. A second segment 52 extends between groove 44 at the tip of one bow limb to the groove 48 at the other bow limb. Similarly, a third segment 53 extends between the remaining groove 44 and the groove 48 at the first end. The cable is usually transferred between the grooves 44 and 45 by an opening, such as a slot or aperture, extending laterally of pulley 43. Segment 50, referred to as the bow string, is generally parallel to the longitudinal axis A of bow 20. Segment 52 and 53 are oblique to longitudinal axis A, normally crossing at the approximate midpoint of the bow. The arrow is propelled by the bow string segment 50. To provide substantial clearance for the fletchings at the rear of the arrow, segments 52 and 53 are pulled laterally and retained in the spaced relationship from segment 50 by cable guard 54 which projects rearwardly from handle riser 22, as further viewed in FIG. 3, a distance sufficient to accommodate the maximum displacement of cable segment 52 and 53.

As bow string 50 is drawn rearwardly by the archer, the force induced into cable 49, acting through the pulley or cam assemblies at the opposite ends of the bow, tend to move the tip ends 25 together. Resultingly, each bow limb 23 is flexed and stressed in a rearwardly directed curve storing the energy which will subsequently supply a component of the propelling force for the arrow. As will be readily understood by those skilled in the art and consistant with the primary advantage of a compound bow, the tension in cable 49 is not equalized throughout the several segments. Correspondingly, the several pulley grooves are subjected to unequal force.

A force of given magnitude is applied to outboard groove 45 of pulley 43. A force of approximately twice the given magnitude is applied to the inboard groove 44 of the pulley 43 with an approximately equal force being applied to groove 48 of the smaller pulley 47. In a sixty pound bow, for example, sixty pounds of force is applied to the grooves 48 and 44 while thirty pounds of force is applied to the groove 45.

In the illustrative typical bow 20, groove 44 is aligned along the longitudinal axis A. As seen with further clarity in FIG. 3, grooves 48 and 45 are laterally displaced from the longitudinal axis A. Groove 45 is offset to the right a distance designated B. Groove 48 is offset to the left a distance designated C. For purposes of explanation, the force transmitted to groove 45 can be given the value F. The force exerted upon grooves 44 and 48 is, correspondingly, 2F.

Torque, as is well-known, is a function of distance and force. Since groove 44 is aligned upon the longitudinal axis, the distance component is zero (0) resulting in a torque calculation of $(0)\times(2F)$. The torque exerted upon bow limb 23 through groove 45 is given by the notation $(F)\times(B)$. Similarly, the force exerted upon bow limb 23 through groove 48 is given by the notation $(2F)\times(C)$. In the immediate case, the distance B is equal to the distance C. Therefore, twice as much torque is applied to tip section 39 as to tip section 38.

Ideally, bow string 50 moves through a plane which is parallel to the longitudinal axis of the bow and perpendicular to the target or point of aim. This assumes a balanced load upon the bow limb 23 as the edges 27 and 28 move in unison through congruent curves. In actual practice, however, due to the greater force transmitted through tip section 39, the curve of edge 28 is more severe than the curve of edge 27. Accordingly, torsion is induced into bow limb 23 in the general direction of the arrowed line D. In response thereto, bow string 50 moves through a plane which is oblique to the line of sight or the previously described plane perpendicular to the target.

The arrow is subject to the resultant force stored in bow limb 23. It is apparent from the foregoing explanation that the arrow propelling force includes a first component directed along the plane perpendicular to the target and a second torsional force which is oblique to the plane perpendicular to the target. Empirical observation has shown that, in a conventional sixty pound compound bow, the limb may twist as much as one-eighth of one inch as a result of the torsional forces. This can be responsible for as much as ten inches of lateral dispersion of the arrow at forty yards.

Figure 4:
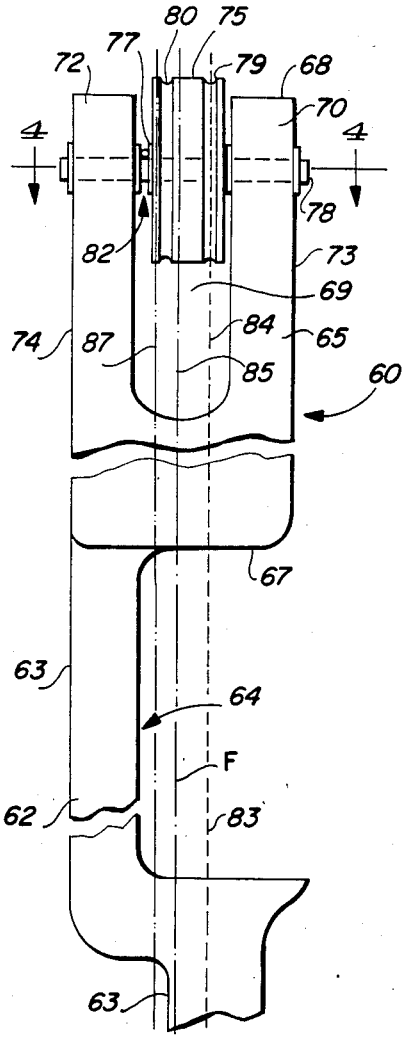
FIG. 4 (PRIOR ART)
FIG. 4 is a view generally corresponding to the view of FIG. 1 and illustrating another typical prior art device.

FIG. 4 illustrates another configuration of conventional prior art compound bows generally designated by the reference character 60. In general similarity to bow 20, bow 60 includes handle riser 62 having hand grip 63, a sight window 64 and oppositely extending bow limbs 65 each having fixed ends 67 and tip ends 68. Slot 69 extending inwardly from tip end 68 divides the terminal portion of bow limb 65 into tip sections 70 and 72. In order to accommodate a wider slot 69, the edges 73 and 74 of bow limb 65 are substantially parallel.

Analogous to the previously described prior art bow, the immediate embodiment includes a pulley assembly including eccentric pulley 75 and smaller tieoff roller 77 rotatably carried upon axle 78 supported by the equal strength tip sections 70 and 72. Pulley 75, like the previously described counterpart 43, includes outboard groove 79 and inboard groove 80. Groove 82 is formed in roller 77. A greater distance, however, exists between the grooves of the larger pulley. A similar bow limb carrying a mirror image pulley assembly (not herein specifically illustrated) extends in the opposite direction from handle riser 62.

Cable 83 communicates between the two pulley assemblies. Bow string 84 extends between corresponding grooves 79. Cable segment 85 extends between a groove 80 and the groove 82 at the opposite end thereof. Segment 87 extends between the remaining grooves 80 and 82. The greater distance between grooves 79 and 78 is for the express purpose of providing sufficient lateral separation between bow string 84 and segments 85 and 87 to accommodate the fletching of the arrow without resorting to extraneous means such as cable guard 54.

Figure 5:
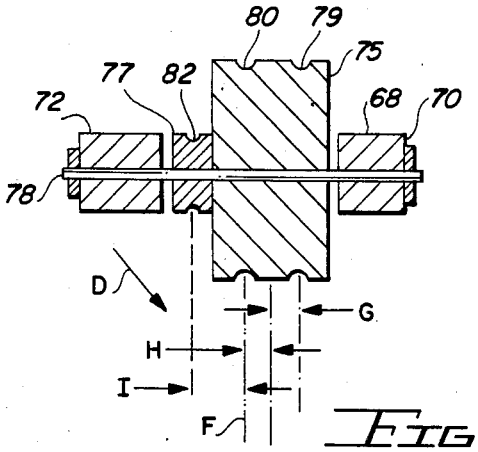
FIG. 5 is a horizontal sectional view taken along the line 5—5 of FIG. 4.

The longitudinal axis or center line of bow 60 is represented by broken line F. As seen with greater clarity in FIG. 5, grooves 79, 80, and 82 are offset from longitudinal axis F by the distances G, H, and I respectively. Grooves 80 and 82 are offset to the same side which is opposite the side to which groove 79 is offset. As previously described, the force of given magnitude is applied to groove 79. A force of twice the given magnitude is applied to each of the grooves 80 and 82.

It is apparent from the foregoing that torsional forces are applied directly to the tip sections 70 and 72 which are transmitted to bow limb 65. The torsional force supported by tip section section 70 is equal to $(F)\times(G)$. A torsional force absorbed by tip section 72 is equal to the sum of $(2F)\times(H)$ and $(2F)\times(I)$. It is noted that the distance H is less than the distance G and that the distance I is greater than the distance G. Accordingly, torsional force in the direction of the previously described arrowed line D with corresponding results is applied to each of the bow limbs 65.

Figure 6:
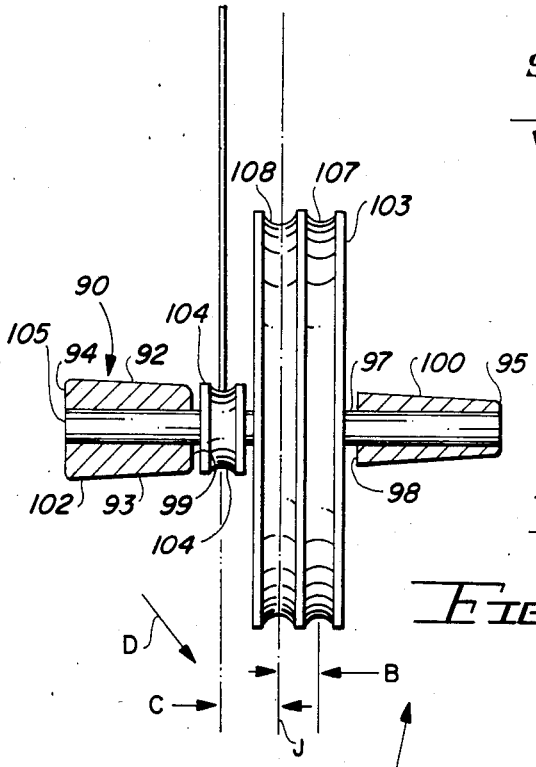
FIG. 6 is a view generally corresponding to the views of FIGS. 3 and 5 but illustrating an improved bow limb constructed in accordance with the teachings of the instant invention.

Attention is now directed to FIG. 6 which illustrates an improved bow limb constructed in accordance with the teachings of the instant invention and generally designated by the reference character 90. In general similarity to conventional prior art bow limbs, bow limb 90 includes front face 92, rear face 93, and edges 94 and 95. Slot 97 having lateral sides 98 and 99 bifurcates the terminal portion of the tip end into tip sections 100 and 102. A pulley assembly including pulley 103 and tieoff roller 104 is rotatably supported upon axle 105 within slot 98. The terminal portions of axle 105 are supported by tip sections 100 and 102. Larger pulley 103 carries outboard groove 107 and inboard groove 108 while groove 109 is carried by tieoff roller 104.

The longitudinal axis or center line of bow limb 90 is represented by the broken line J. For arbitrary purposes of illustration and direct comparison to previously described prior art bow limb 20, inboard groove 108 of larger pulley 103 is considered to be aligned along the longitudinal axis J. As previously set forth, the center line of groove 107 resides a distance B from the longitudinal axis while groove 109 resides a distance C from the center line. The distances B and C extend on opposite sides of the center line. Also as previously noted groove 109 is subjected to a force having twice the magnitude of the force acting upon groove 107. Assuming the distances B and C to be equal, the force upon that portion of the bow residing between the longitudinal axis and the edge 94, the left hand side in the immediate illustration, is twice the load imposed upon the right hand side of the illustration, or that portion of bow limb 90 residing between the longitudinal axis and edge 95. The resultant is a twisting or torsional force in the direction of arrowed line D.

To nullify the effects of the non-uniform or unbalanced loading between edges 94 and 95, bow limb 90 is configured to have greater cross sectional area between the longitudinal axis and edge 94 than between the longitudinal axis and edge 95. While this configuration may assume various specific shapes bounded by a selected combination of straight and curved lines, as will be appreciated by those skilled in the art, a cross-section defined by four substantially straight lines, such as a truncated triangle, a trapezium or a trapesoid, are prefaced for purposes of manufacture. For purposes of clarity of illustration and ease of understanding, the form of a trapezoid has been chosen. Edges 94 and 95 are substantially parallel. Front face 92 and rear face 93 are convergent in a direction toward edge 95 away from the heavier loaded left side of the bow limb. Accordingly, tip section 102 and a portion of bow limb 90 adjacent edge 94 is more resistant to bending. The greater resistance to bending is directly proportional to the unbalanced load. Assuming bow limb 90 to be fabricated of material of uniform strength, the angle between front face 92 and rear face 93 is calculated to yield a configuration whereby the force applied to a first side of the bow limb times the cross-sectional area of the second side equals the force applied to the second side times the cross-sectional area of the first side.

Figure 8:
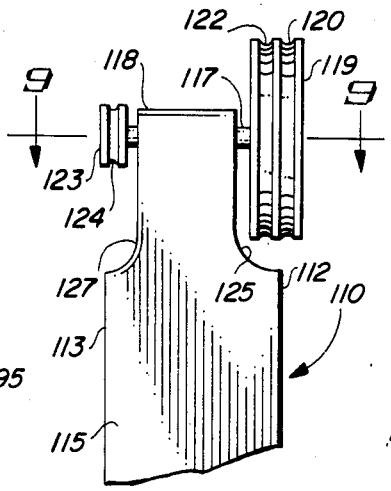
FIG. 8 is a vertical section view taken along the line 9—9 of FIG. 7.
Figure 7:
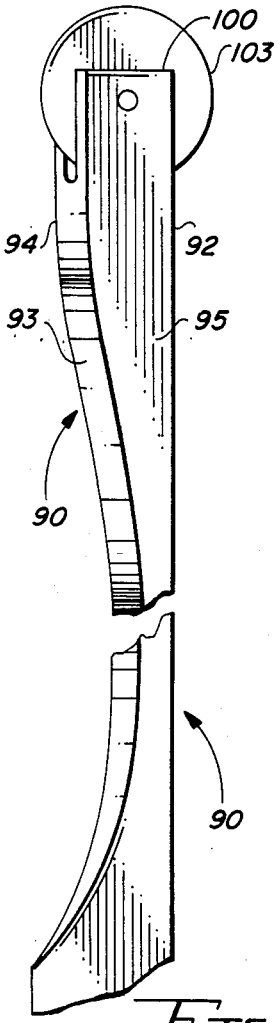
FIG. 7 is an elevational view of the tip and terminal portion of another bow limb embodying the improvements of the instant invention.

In the embodiment of the invention illustrated in FIG. 6, the bow string is sufficiently close to the other cable segments as to require means, such as cable guard 54, to provide sufficient room for clearance of the arrow fletchings. An alternate bow limb, constructed in accordance with the teachings of the instant invention generally designated by the reference character 110 as illustrated in FIGS. 7 and 8 provides ample clearance between the bow string and the other cable segments. In general similarity to the previously described embodiment, bow limb 110 is generally trapezoidal in cross-section having parallel edges 112 and 113 and angularly disposed front face 114 and rear face 115 which converge in a direction toward edge 113. Axle 117 extends through bow limb 110 proximate tip end 118. Eccentric pulley 119 having an outboard groove 120 and inboard groove 122 is rotatably supported upon axle 117 outboard of edge 112. Smaller tieoff roller 123 having groove 124 is carried upon axle 117 outboard of edge 113. Since the clearance for the arrow fletchings does not require a separation of the pulleys equal to the full width of the bow limb, the terminal portion of bow limb 110 adjacent tip end 118 may be narrowed by recesses 125 and 127 along edges 112 and 113, respectively.

The center line or longitudinal axis of bow limb 110 is represented by the broken line L. Grooves 120 and 122 are offset to one side of axis L by distances represented as M and N, respectively. Groove 124 is offset to the other side by a distance represented as O. An equal force is applied to groove 122 and to groove 124, which force is of twice the magnitude of the force applied to groove 120. The angle between front face 114 and rear face 115 necessary to nullify the torsional effects and ensure uniform bending across bow limb 110 is calculated as previously described in connection with FIG. 6. Similarly, the trapezoidal cross-section tapers to a rectangular cross-section at an intermediate point of the bow limb.

The foregoing embodiments of the instant invention assume that the loading upon a bow limb is inherently unbalanced as a result of conventional pulley configuration. Remedy is provided in the form of improved bow limbs 90 and 110. Also provided by the instant invention is an improved bow limb which is inherently balanced as a result of redistribution of the forces acting upon the bow limb.

Figure 10:
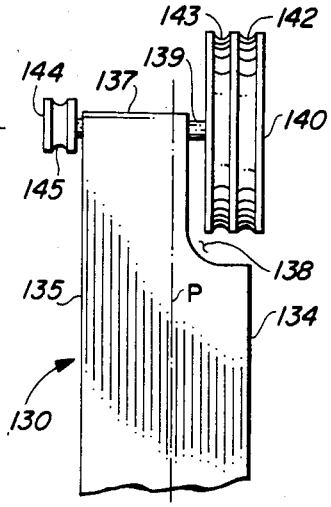
FIG. 10 is a top plan view of the embodiment of FIG. 9.
Figure 9:
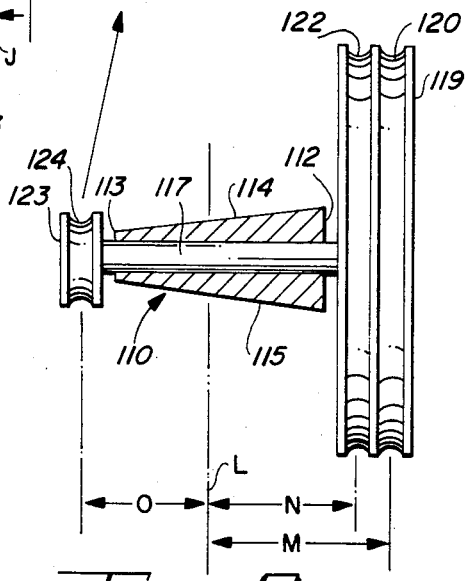
FIG. 9 is a view generally corresponding to the view of FIG. 7 and showing yet another embodiment of the instant invention.

Referring now to FIGS. 9 and 10 there is seen an improved bow limb embodying the teachings of the instant invention and generally designated by the reference character 130. Bow limb 130, which is generally rectangular in cross-section, includes front face 132, rear face 133, edges 134 and 135, and tip end 137. The terminal portion of bow limb 130 is narrowed by recess 138 extending inwardly from tip end 137 and edge 134.

Axle 139 extends laterally through bow limb 130 proximate tip end 137. Eccentric pulley 140 having outboard groove 142 and inboard groove 143 is supported upon axle 139 to substantially reside within recess 138. Smaller tieoff roller 144 having groove 145 is carried by axle 139 adjacent edge 135.

The longitudinal axis or central line of bow limb 130 is represented by the broken line designated by the reference character P. As previously described, the bow limb is subjected to various forces which are applied to the several pulley grooves. A force of magnitute X is applied to the groove 142. A force having a magnitude 2X is applied to groove 143 and groove 145. The resultant of the forces applied to grooves 142 and 143 is a force of 3X at a distance Q from longitudinal axis P in a direction toward edge 134. The force 2X applied to groove 145 is at a distance R from axis P in a direction toward edge 135. Balance of the bow limb, i.e., equalization of potential torque on either side of the longitudinal axis P, is achieved in accordance with the equation $(2F)\times(R)=(3F)\times(Q)$. The formula becomes an equation when the distance R is one and one-half times the distance Q. Similarly, bow limb 130 achieves inherent balance when the recess 138 is of sufficient depth that the pulley 140 may be mounted upon axle 139 to achieve the relative ratio between distance Q and R. The remaining component of the terminal portion of bow limb 130, after being narrowed by recess 138, functions as spacer means between pulley 140 and roller 144 to insure or maintain the desired distance.

It is also a teaching of the instant invention that the terminal portion of bow limb 130 not be narrowed by recess 138 and pulley 140 reside outboard of edge 134. Accordingly, the length of axle 139 is extended and the spacer means be expanded to include an element residing intermediate roller 144 and edge 135.

Figure 11:
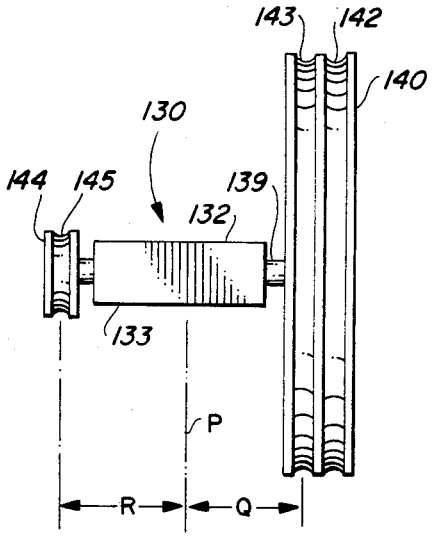
FIG. 11 is a view generally corresponding to the view of FIG. 5 and showing yet another means of providing an improved bow limb in accordance with the teachings of the instant invention.

FIG. 11 illustrates another embodiment of the invention generally designated by the reference character 150 incorporating a pulley arrangement specially devised to provide inherent balance. Bow limb 150 which includes front face 152, rear face 153 and edges 154 and 155, has a terminal portion adjacent the tip end which is bifurcated by slot 157 to create tip sections 158 and 159 of equal cross-section and comparative strength and rigidity.

Unitary pulley assembly 160 is supported by axle 162 to reside within slot 157. Pulley assembly 160 includes eccentric pulley 163 and tieoff roller 164 integrally carried at opposite ends of hub 165. Hub 165, which functions as spacer means may be affixed to pulley 163 and roller 164 by various well known mechanical or adhesive expediencies. Alternatively, the assembly 160 may be cast or molded as an integral unit.

Consistant with the previously described pulley assemblies, pulley 163 includes outboard groove 167 and inboard groove 168 while tieoff roller 164 carries groove 169. The forces acting upon grooves 167, 168, and 169 are analogous to the previously described forces acting upon groove 142, 143, and 145, respectively, of the embodiment in FIGS. 9 and 10, The relative distances from the center line of bow limb 150 to achieve inherent balance are calculated as previously described in connection with the embodiment generally designated by reference character 130.

Figure 12:
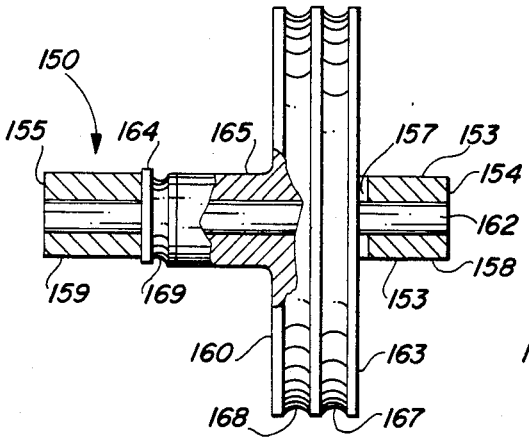
FIG. 12 is a horizontal sectional view, generally corresponding to the view of FIG. 2, and showing yet another improved bow limb of the instant invention.
Figure 13:
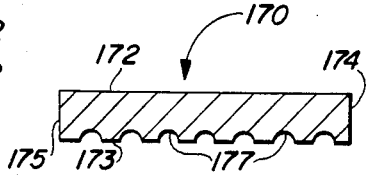
Figure 14:
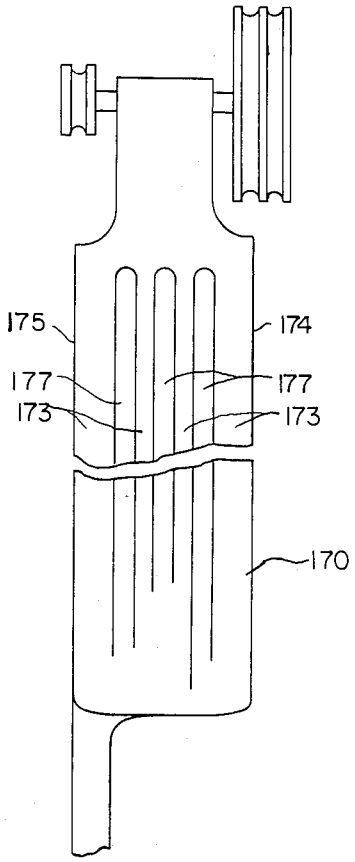

Turning now to FIG. 12 there is seen yet another improved bow limb of the instant invention, generally designated by the reference character 170 which, being generally rectangular in cross-section, includes front face 172, rear face 173, and edges 174 and 175. A plurality of longitudinally extending alternating grooves 177 and ribs 178 are formed in rear face 173. Empirical observation, utilizing a bow limb so constructed, indicates that the immediate configuration serves to reduce undesirable torsion. It has been determined that in a bow limb having a width of two inches, a plurality of grooves each apporximately sixty thousandths of an inch wide by ten thousandths of an inch deep and spaced sixty thousandths of an inch apart, yields satisfactory results. Preferably, the grooves and ribs commence proximate the tip of the limb and extend for a predetermined distance. In accordance with an embodiment of the invention, the grooves become progessively shallow, finally diminishing at the point near the handle riser.

Bow limb 170, and the previously described embodiments of the instant invention, may be fabricated in accordance with conventional techniques to produce such structures as laminated or fiber-reinforced plastic. Laminated structures generally include layers of wood and fiberglass while fiber-reinforced plastic structures generally include either glass fibers or graphite imbedded in epoxy resin. The grooves 177, as will be appreciated by those skilled in the art, can be machined subsequent to fabrication of the bow limb. Alternately, the grooves and ribs can be molded in place during fabrication. Preferably, the grooves take the form of flutes having a cross-section which is a portion of a circle or an ellipse. It is also apparent that bow limb 170 may be fabricated with a trapezoidal, or other selected cross-section, to be utilized in combination with the previously described embodiments of the instant invention.

Various changes and modifications to the embodiments herein chosen for purposes of illustration will readily occur to those skilled in the art. For example, while the ribs 177 have been shown as having a planar face, the ribs could be fabricated with a rounded or elliptical cross-section. Similarly, while the several embodiments of the invention have been independently illustrated and described, it is understood that the several embodiments are not mutually exclusive. That is, the features of one embodiment, as will be appreciated by those skilled in the art, may be combined with the features of another embodiment. For example, unitary pulley assembly 160, as viewed in FIG. 11, may be utilized with a bow limb of varying cross-section. It is also understood that the terminal portion of the bow limb actually supporting the pulley and the roller may be a bracket, such as can be fabricated of metal, which is attached to the limb proper. To the extent that such modifications and variations do not depart from the spirit of the invention, they are intended to be included within the scope thereof which is limited only by a fair assessment of the following claims.

Having fully described and disclosed the present invention and alternatively preferred embodiments thereof in such clear and concise terms as to enable those skilled in the art to understand and practice the same.

The invention claimed is:

1. A compound bow, comprising:

first and second one piece limbs each having a front face, a rear face, a first side, and a second side wherein said sides are adjacent to said front face and said rear face, and a crotch at one end thereof for defining a pair of spaced apart crotch arms separated by a receiving space at each end of said bow;

a pulley assembly including a two adjacent element pulley/cam structure and a tieoff element at each bow end and accommodated within said receiving space between said crotch arms, each said crotch extending into only a portion of each of said first and second one piece limbs from the ends thereof sufficient to accommodate said pulley assembly, the remainder of each of said first and second limbs being of a unibody construction;

a cable which extends from a first tieoff element at a first bow end to a first element of the pulley/cam structure at the second bow end, is transferred to the adjacent second element, then extends parallel to the longitudinal bow axis to a second element of the pulley/cam structure at the first bow end, is transferred to the adjacent first element, and then extends to a tieoff element at the second bow end, wherein a restoring force is stored in each of said one piece limbs when the compound bow is drawn;

a. the restoring force being comprised of unequal components contributed by the respective two sides of each of said first and second one piece limbs about the bow longitudinal axis, said unequal components comprising first and second cross-sectional areas of said crotch arms on the respective two sides about the bow longitudinal axis, said first cross-sectional area being greater than said second cross-sectional area and said first cross-sectional area being adjacent to the tieoff element said first and second cross-sectional areas being obtained by utilizing a limb cross-sectional shape wherein said first side is thicker and said front face and rear face converge from said first side to said second side which is thinner;

b. the difference between said unequal components being predetermined to exert a torsional force on the bow end which balances a torsional force on the bow end imparted to the bow end by the summation of forces applied to the pulley/cam structure and a tieoff element by the cables;

thereby eliminating limb/pulley torque.

2. The compound bow of claim 1 in which the pulley/cam structure and the tieoff element at each bow end are journalled for rotation about a common axis of rotation.

3. The compound bow of claim 1 in which the pulley/cam structure and the tieoff element at each bow end are juxtaposed and journalled for rotation about a common axle and in which said common axle is supported by said crotch arms.

4. The compound bow of claim 1 in which the pulley/cam structure and the tieoff element at each bow end are journalled for rotation about a common axle of rotations and in which said common axle is supported by said crotch arms.

5. The compound bow of claim 1 in which the cross-sectional profile of the two limbs of said bow are mirror images.

6. The compound bow of claim 5 in which the cross-section of each limb proximate said crotch arms thereof is generally trapezoidal.

7. The compound bow of claim 6 in which the pulley/cam structure and the tieoff element at each bow end are journalled for rotation about a common axis of rotation.

8. The compound bow of claim 6 in which the pulley/cam structure and the tieoff element at each bow end are juxtaposed and journalled for rotation about a common axle and in which said common axle is supported by said crotch arms.

9. The compound bow of claim 6 in which the pulley/cam structure and the tieoff element at each bow end are journalled for rotation about a common axle of rotation and in which said common axle is supported by said crotch arms.

10. The compound bow of claim 9 in which the pulley/cam structure is disposed closer to the bow longitudinal axis than the tieoff element.

11. The compound bow of claim 10 in which one of said crotch arms is relieved to accommodate the pulley/cam structure.

12. The compound bow of claim 10 in which both of said crotch arms are relieved to accomodate, respectively the pulley/cam structure and the tieoff element.

13. The compound bow of claim 5 in which the pulley/cam structure and the tieoff element at each bow end are journalled for rotation about a common axis of rotation.

14. The compound bow of claim 5 in which the pulley/cam structure and the tieoff element at each bow end are juxtaposed and journalled for rotation about a common axle and in which said common axle is supported by said crotch arms.

15. The compound bow of claim 5 in which the pulley/cam structure and the tieoff element at each bow end are journalled for rotation about a common axle of rotation and in which said common axle is supported by said crotch arms.

16. The compound bow of claim 1 in which the pulley/cam structure and the tieoff element at each bow end are journalled for rotation about a common axis of rotation.

17. In a compound bow having first and second bow limbs each having a cross-section, said cross sections each comprising a front face, a rear face, a first side, and a second side wherein said sides being adjacent to said front face and said rear face, and wherein said first side is thicker and said front face and said rear face converges from said first side to second side which is thinner, said compound bow further having a pulley/cam structure and a tieoff element at the end of each bow limb in conjunction with a cable which extends from a first tieoff element at a first bow end to a first element of the pulley/cam structure at the second bow end, is transferred to the adjacent second element, then extends parallel to the longitudinal bow axis to a second element of the pulley/cam structure at the first bow end, is transferred to the adjacent first element, and then extends to a tieoff element at the second bow end, improvements therein for decreasing the effect of the torsional force applied to the bow by the summation of forces applied to the pulley/cam structure and the tieoff element by the cable, said improvements comprising: at least one longitudinally extending groove formed into said rear face.

18. The improvements of claim 17, wherein said groove extends from proximate each bow end for a predetermined distance along said face.

19. The improvements of claim 18, wherein said groove is in the form of a flute.

20. The improvements of claim 18, wherein said groove is formed in the rear face of said bow.

21. The improvements of claim 18, wherein said groove is one of a plurality of grooves spaced apart to form a rib between each adjacent groove.

* * * * *